US009096064B2

(12) United States Patent
Tone

(10) Patent No.: US 9,096,064 B2
(45) Date of Patent: Aug. 4, 2015

(54) INK JET PRINTING APPARATUS, PRINT HEAD RECOVERY DEVICE AND PRINT HEAD RECOVERY METHOD

(71) Applicant: CANON FINETECH INC., Misato-shi (JP)

(72) Inventor: Kensuke Tone, Kawasaki (JP)

(73) Assignee: CANON FINETECH INC., Misato-shi (JP)

( * ) Notice: Subject to any disclaimer, the term of this patent is extended or adjusted under 35 U.S.C. 154(b) by 0 days.

(21) Appl. No.: 13/863,716

(22) Filed: Apr. 16, 2013

(65) Prior Publication Data

US 2014/0210906 A1 Jul. 31, 2014

(30) Foreign Application Priority Data

Jan. 31, 2013 (JP) ..... 2013-017176

(51) Int. Cl.
*B41J 2/165* (2006.01)

(52) U.S. Cl.
CPC .... *B41J 2/16532* (2013.01); *B41J 2002/16573* (2013.01)

(58) Field of Classification Search
USPC ..... 347/34, 29–30
See application file for complete search history.

(56) References Cited

U.S. PATENT DOCUMENTS

2008/0049066 A1* 2/2008 Inoue ..... 347/33
2008/0211860 A1* 9/2008 Yamaguchi et al. ..... 347/30
2012/0056933 A1* 3/2012 Tanaka et al. ..... 347/30
2012/0139979 A1* 6/2012 Tokuno ..... 347/6

FOREIGN PATENT DOCUMENTS

JP 2005-225163 A 8/2005
JP 2007-118508 A 5/2007

OTHER PUBLICATIONS

Japanese Office Action issued in Japanese Patent Application No. 2013-017176, dated Dec. 16, 2014.

* cited by examiner

*Primary Examiner* — Jason Uhlenhake
(74) *Attorney, Agent, or Firm* — Fitzpatrick, Cella, Harper & Scinto

(57) ABSTRACT

In an ink jet printing apparatus prints an image by employing a print head capable of ejecting ink from ejection ports, a suction unit draws ink from the ejection ports into an interior of the cap by applying a suction force to the interior of a cap that is covering the ejection ports. An atmosphere communication unit exposes to the atmosphere the interior of the cap that is covering the ejection ports, and a pressure increase unit increases a pressure in an internal of the print head. A control unit permits the suction unit to apply the suction force to the interior of the cap, and permits the pressure increase unit to increase the pressure in the internal of the print head before the atmosphere communication unit exposes the interior of the cap to the atmosphere in a state where the ejection ports is covered with the cap.

8 Claims, 14 Drawing Sheets

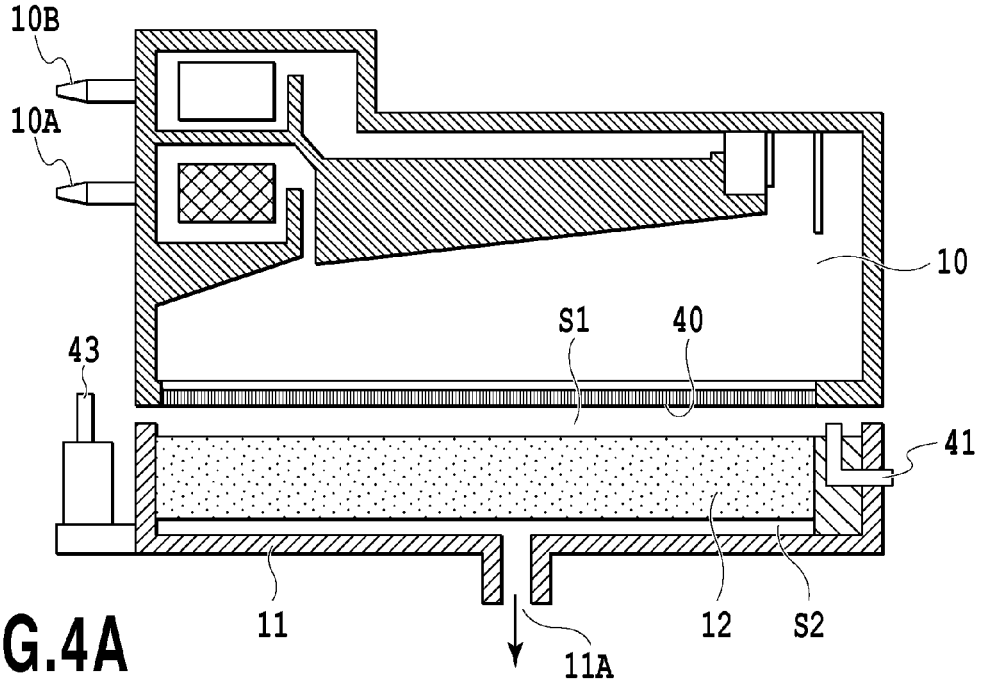
FIG.4A
FIG.4B
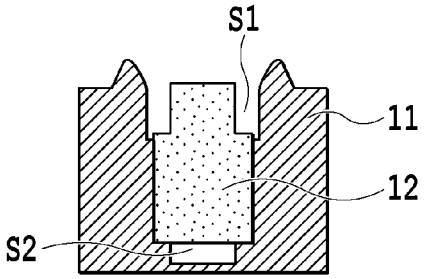
FIG.4C
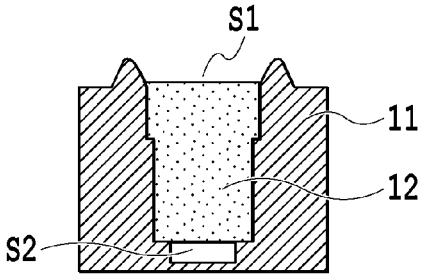

INK JET PRINTING APPARATUS, PRINT HEAD RECOVERY DEVICE AND PRINT HEAD RECOVERY METHOD

BACKGROUND OF THE INVENTION

1. Field of the Invention

The present invention relates to an ink jet printing apparatus that performs a suction-based recovery operation for an ink ejection print head, and a print head recovery device and a print head recovery method that are employed to perform the suction-based recovery operation.

2. Description of the Related Art

For an ink jet printing apparatus that prints an image by employing a print head wherein ink can be ejected from ejection ports formed at nozzle tips, a suction-based recovery operation is well known as a recovery operation for maintaining an appropriate ink ejection state for the print head. The suction-based recovery operation is an operation wherein, while the ejection ports of the print head are covered with a cap (a capping state), a negative pressure is generated by a pump and is introduced into the cap to move, by suction, ink that does not contribute to the printing of an image from the ejection ports into the cap. When the suction-based operation is performed, bubbles generated in the nozzles, and viscous ink and foreign substances, such as dust, in the nozzles can be discharged to maintain an appropriate ink ejection state.

According to a printing apparatus described in Japanese Patent Laid-Open No. 2007-118508, after a suction-based recovery operation has been performed, and while the capping state of a print head is being maintained, a suction pump is halted to relax the pressure in the print head and in the cap, and thereafter, an atmosphere communication valve, for connecting the interior of the cap with the atmosphere, is opened. Sequentially, then, in the state wherein the atmosphere communication valve has been opened, the suction pump is restarted to introduce external air into the cap via the atmosphere communication valve, and this air stream is employed to clean an ejection port face of the print head, where the ejection ports are formed at the nozzle tips.

However, in the printing apparatus described in Japanese Patent Laid-Open No. 2007-118508, during a period following the suction-based recovery operation and lasting until the atmosphere communication valve has been opened, the suction pump is merely halted to relax the pressure in the print head and the pressure in the cap. Therefore, when the pressure in the two components is relaxed, the pressure in the cap will be slightly lower than the atmosphere, and in this state, the pressure in the print head and the pressure in the cap are evenly balanced, so that ink will not be discharged from the ejection ports into the cap. However, when in this state the atmosphere communication valve is opened, the pressure in the cap rises, and balance is lost between the pressure in the print head and the pressure in the cap. Thus, there is a possibility that air, introduced through the atmosphere communication valve, and foreign substances in the cap, such as dust and viscous ink, will enter the print head through the ejection ports.

SUMMARY OF THE INVENTION

The present invention provides an ink jet printing apparatus that performs a suction-based recovery operation, while preventing foreign substances from entering a print head, and a print head recovery device and a print head recovery method that are employed to perform the suction-based recovery operation.

In the first aspect of the present invention, there is provided an ink jet printing apparatus for printing an image by employing a print head capable of ejecting ink from ejection ports, comprising:

a cap configured to cover the ejection ports;

a suction unit configured to draw ink from the ejection ports into an interior of the cap by applying a suction force to the interior of the cap that is covering the ejection ports;

an atmosphere communication unit configured to expose to the atmosphere the interior of the cap that is covering the ejection ports;

a pressure increase unit configured to increase a pressure in an internal of the print head; and a control unit configured to permit the suction unit to apply the suction force to the interior of the cap, and to permit the pressure increase unit to increase the pressure in the internal of the print head before the atmosphere communication unit exposes the interior of the cap to the atmosphere in a state where the ejection ports is covered with the cap.

In the second aspect of the present invention, there is provided a print head recovery processing device for performing a recovery process for a print head capable of ejecting ink from ejection ports, comprising:

a cap configured to cover the ejection ports;

a suction unit configured to draw ink from the ejection ports into an interior of the cap by applying a suction force to the interior of the cap that is covering the ejection ports;

an atmosphere communication unit configured to expose to the atmosphere the interior of the cap that is covering the ejection ports;

a pressure increase unit configured to increase a pressure in an internal of the print head; and a control unit configured to permit the suction unit to apply the suction force to the interior of the cap, and to permit the pressure increase unit to increase the pressure in the internal of the print head before the atmosphere communication unit exposes the interior of the cap to the atmosphere in a state where the ejection ports is covered with the cap.

In the third aspect of the present invention, there is provided a print head recovery processing method for performing a recovery process for a print head capable of ejecting ink from ejection ports, comprising:

a covering step of covering the ejection ports with a cap;

a drawing step of drawing ink from the ejection ports into an interior of the cap by applying a suction force to the interior of the cap that is covering the ejection ports;

an exposing step of exposing to the atmosphere the interior of the cap that is covering the ejection ports; and an increasing step of increasing a pressure in an internal of the print head, wherein, in a state where the ejection ports are covered with the cap, applying the suction force to the interior of the cap at the drawing step and increasing the pressure in the internal of the print head at the increasing step are performed before exposing the interior of the cap to the atmosphere at the exposing step is performed.

According to the present invention, since the internal pressure in the print head is increased after the suction-based recovery process has been performed, and before the interiors of the caps have been connected to the atmosphere, entering of a foreign substance, via the ejection ports, into the interior of the print head can be prevented.

Further features of the present invention will become apparent from the following description of exemplary embodiments (with reference to the attached drawings).

BRIEF DESCRIPTION OF THE DRAWINGS

FIG. 4A is a cross-sectional view of a cap shown in FIG. 3;

FIG. 4B is a cross-sectional view for explaining an example of an absorber in FIG. 4A;

FIG. 4C is a cross-sectional view for explaining another example of the absorber in FIG. 4A;

DESCRIPTION OF THE EMBODIMENTS

The embodiments of the present invention will now be described based on the accompanying drawings.

First Embodiment

Figure 1:
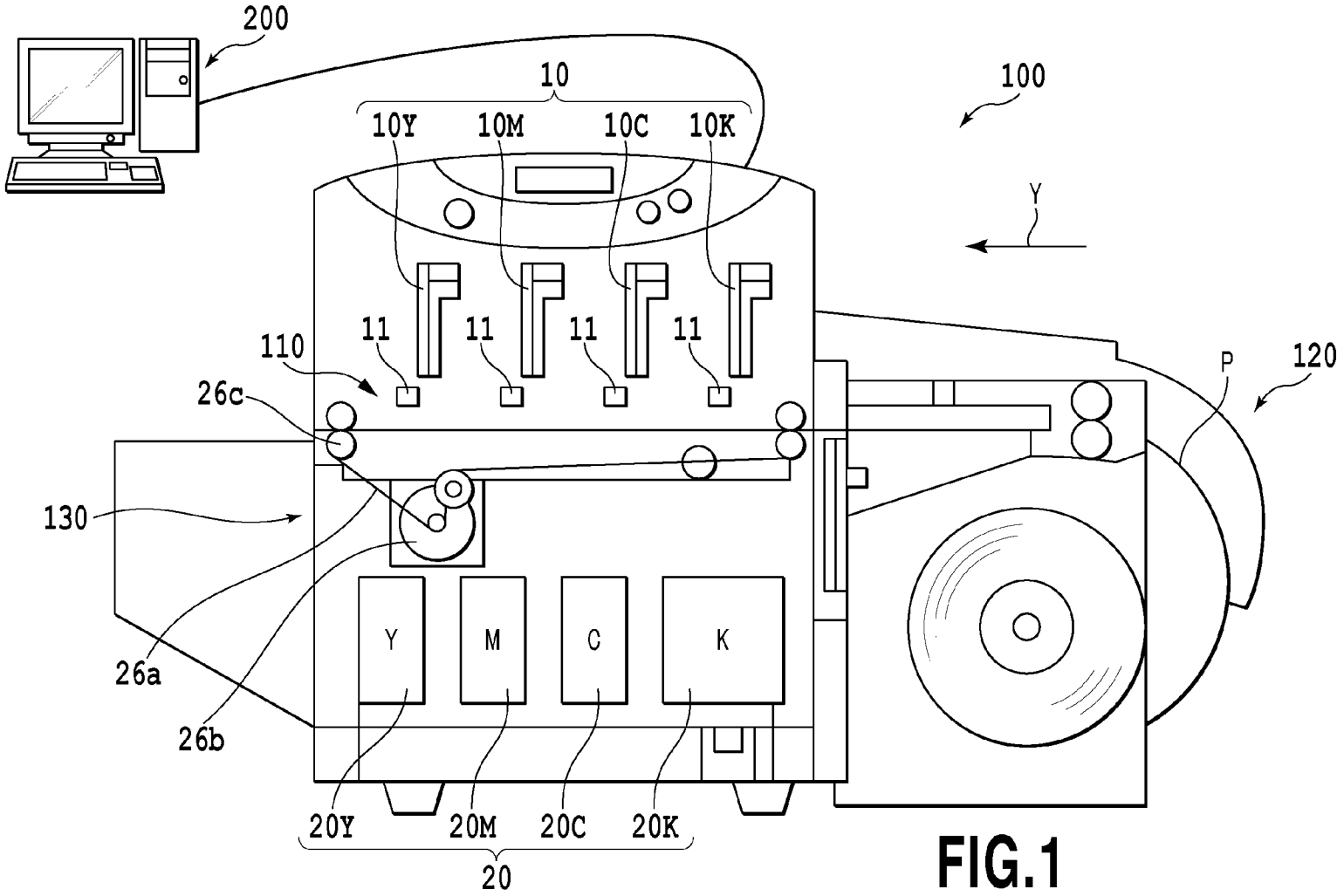
FIG. 1 is a schematic diagram illustrating the arrangement of a printing apparatus according to a first embodiment of the present invention.

FIG. 1 is a schematic front view of an ink jet printing apparatus according to a first embodiment of the present invention. An ink jet printing apparatus (hereinafter referred to simply as a printing apparatus) 100 of this embodiment is full-line type printing apparatus, and is connected to a host PC (a host apparatus) 200. Based on print data received from the host PC 200, the printing apparatus 100 employs four print heads 10 (10K, 10C, 10M and 10Y) to eject black, cyan, magenta and yellow inks, and to print an image on rolled paper (the printing medium) P.

The print heads 10 are elongated line heads that extend across the entire printing region of the rolled paper P in a direction that crosses (in this embodiment, a direction perpendicular to) a direction Y, in which the rolled paper P is to be conveyed. The print head 10K, for the ejection of black ink, the print head 10C, for the ejection of cyan ink, the print head 10M, for the ejection of magenta ink, and the print head 10Y, for the ejection of yellow ink are arranged in the named order in the conveying direction Y. For each of the print heads 10, a plurality of nozzles for ejecting ink are arranged in a direction that crosses (in this embodiment, is perpendicular to) the conveying direction Y, and ejection energy elements, such as electrothermal transducing elements (heaters) or piezoelectric elements, are employed to eject ink through these nozzles. When electrothermal transducing elements are employed, heat is generated to form bubbles in the ink, and bubble generation energy is employed to eject the ink through ejection ports at the nozzle tips. The ejection ports are formed in the ejection port faces of the individual print heads 10.

A recovery unit 110 is provided for the printing apparatus 100, and includes a recovery processor 105 (see FIG. 2) for maintaining an appropriate ink ejection state for the print heads 10. Since the recovery unit 110 periodically cleans the ejection port faces of the print heads 10, an appropriate ink ejection state for the print heads 10 can be maintained. The recovery unit 110 also includes caps 11 that closely contact (capping) the ejection port faces of the print heads 10 during the cleaning operation.

The rolled paper P is fed by a feeding unit 120, and is conveyed, in a direction indicated by an arrow Y, by a conveying mechanism 130 included in the printing apparatus 100. The conveying mechanism 130 of this embodiment employs a conveying belt to convey the rolled paper P.

For the printing of an image, when a printing position on the rolled paper P that is being conveyed has reached a position opposite the print head 10K, the print head 10K ejects black ink based on print data received from the host PC 200. Similarly, the print head 10C, the print head 10M and the print head 10Y eject cyan, magenta and yellow inks, in the named order, and color images are printed on the rolled paper P. The printing apparatus 100 includes cartridge type ink tanks (hereinafter also referred to as "ink cartridges") 20 (20K, 20C, 20M and 20Y), wherein inks are stored that are to be supplied to the individual print heads 10. An ink supply unit 106 (see FIG. 2) supplies inks from the ink cartridges 20 to the corresponding print heads 10.

Figure 2:
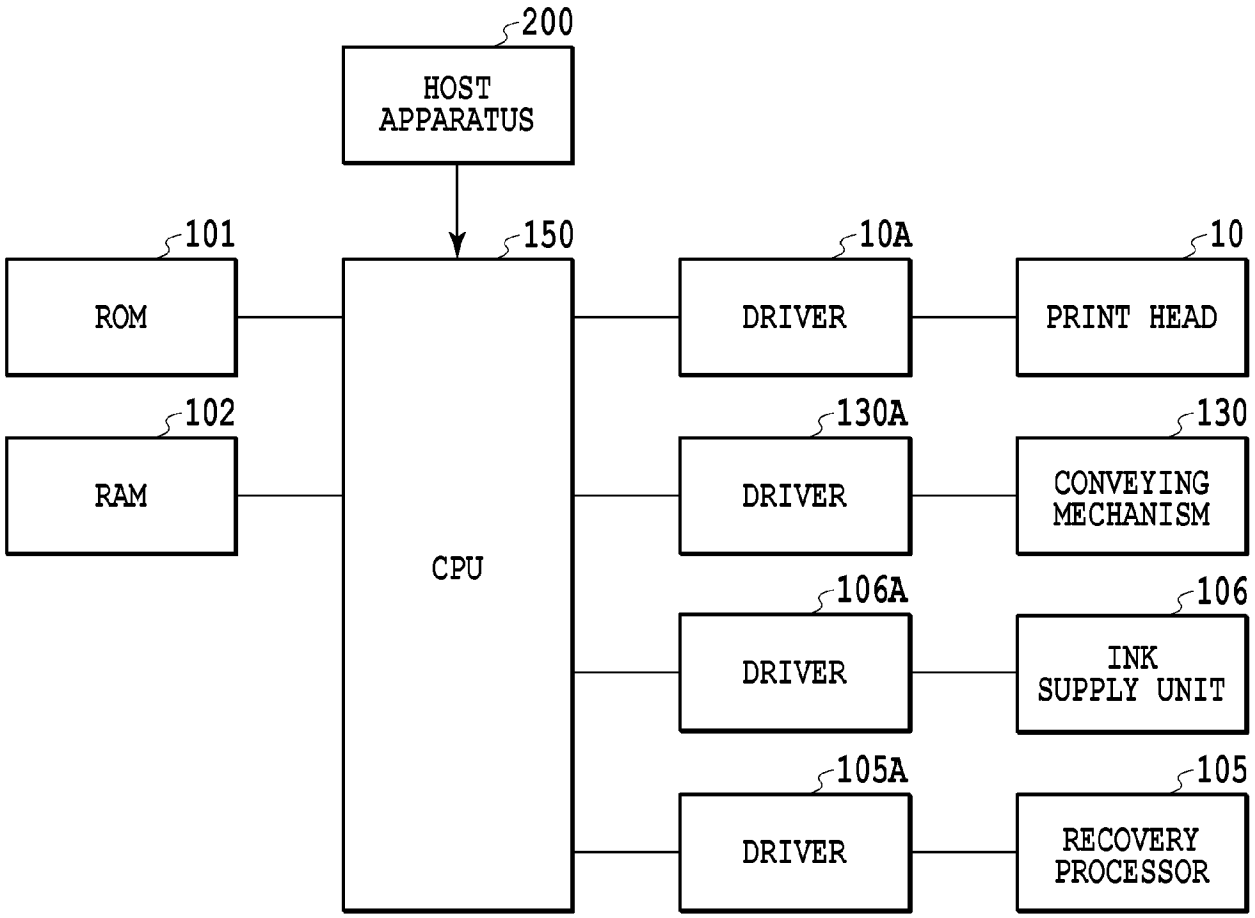
FIG. 2 is a block diagram illustrating the arrangement of a portion of the control system of the printing apparatus in FIG. 1.

FIG. 2 is a schematic block diagram illustrating the arrangement of the control system of the printing apparatus 100 in FIG. 1. A CPU 150 controls the operation of the printing apparatus 100, and performs the required data processing, in order to perform the processes shown in the flowcharts in FIGS. 5, 6 and 7, which will be described later. A ROM 101 is employed for storing programs for these processes, and a RAM 102 is employed as a work area for performing these processes. For the ejection of ink from the print heads 10, the CPU 150 permits a driver 10A to drive ejection energy generation elements, such as electrothermal elements. The CPU 150 also employs drivers 105A, 106A and 130A for controlling the recovery processor 105, the ink supply unit 106 and the conveying mechanism 130.

Figure 3:
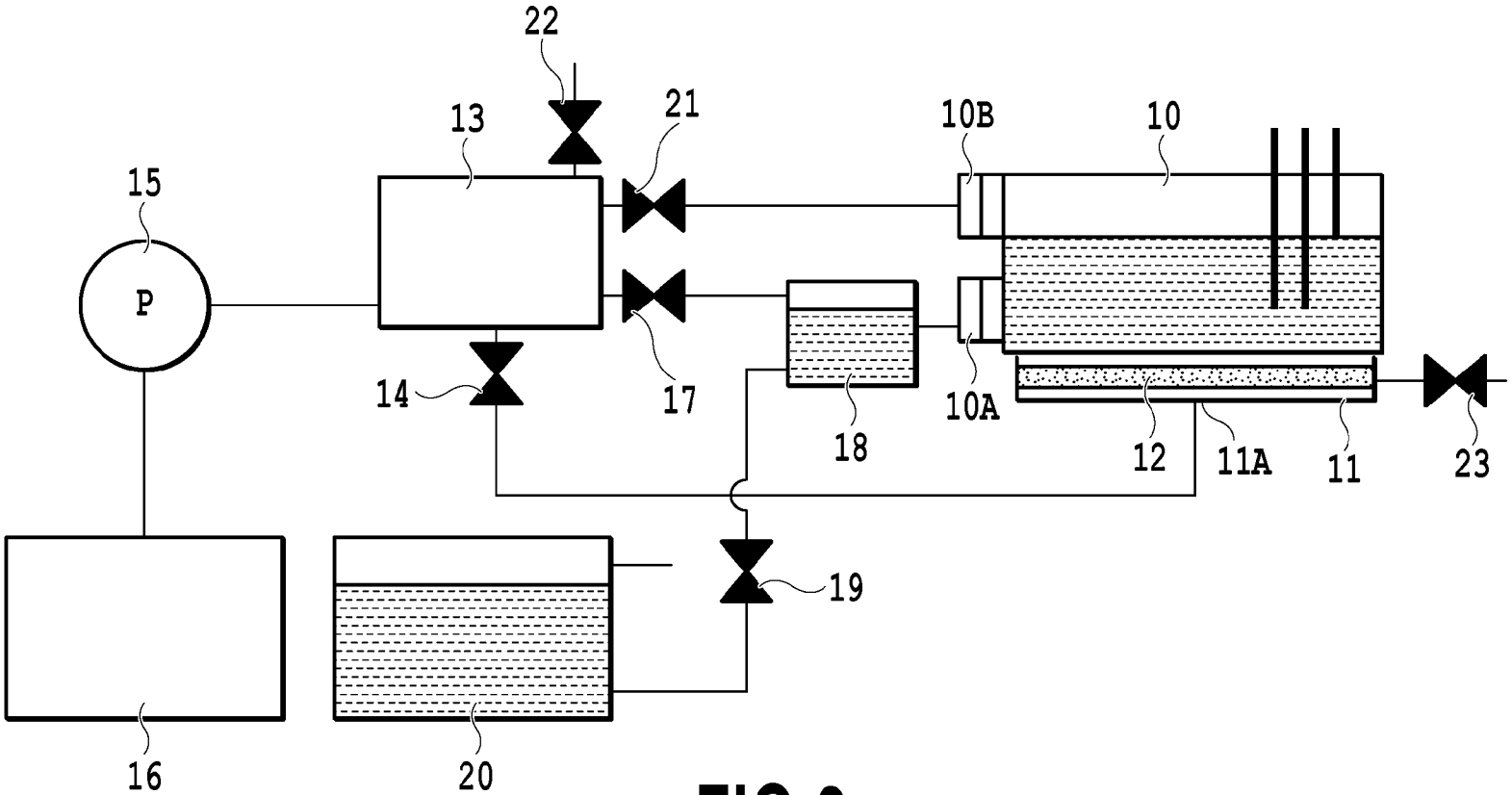
FIG. 3 is a schematic diagram illustrating the arrangement of a recovery system employed for the printing apparatus in FIG. 1.

FIG. 3 is a schematic diagram illustrating the arrangement of a recovery system that includes the recovery processor 105 and the ink supply unit 106. Since the same structure is employed for the recovery systems of all the individual print heads 10, the recovery system for only one print head 10 will be employed for the following description.

The cap 11 is located opposite an ejection port face 40 (see FIG. 4A) of the print head 10, and as shown in FIG. 4A, an absorber 12 provided for the cap 11 divides the inner space of the cap 11 into an ejection port side space S1 and a bottom side space S2. The absorber 12 may have a protruded shape in cross section, as shown in FIG. 4B, or a shape having a flat upper face, as shown in FIG. 4C. It should be noted that the cross sections in FIGS. 4B and 4C are taken from the side (right side in FIG. 4A) of the cap 11 in FIG. 4A. The absorber 12 having the shape, in cross section, shown in FIG. 4B provides high ink absorption efficiency for ink (including a liquid column that will be described later) during the suction-based recovery operation that will be described later. The possible reason for this is that the portion of the absorber 12 opposite the ejection port face 40 is small, and thus, suction force is concentrated on this portion.

A suction port 11A, formed in the bottom of the cap 11, is connected, via a recovery valve 14, to a buffer 13 used to temporarily store suction pressure that is to be applied to evacuate the interior of the cap 11. The buffer 13 is connected, via a suction pump 15 that generates a negative pressure, to a maintenance tank 16 used to store waste ink. The print head 10 includes an ink storage portion that communicates with an ink supply port 10A, and an air extraction chamber 18, wherein bubbles evacuated from the print head 10 are temporarily stored, is connected to the ink supply port 10A. The lower portion of the air extraction chamber 18 is connected to the ink cartridge 20 via a refill valve 19, while the upper portion of the air extraction chamber 18 is connected to the buffer 13 via an air relief valve 17.

A pressure introduction port 10B communicates with the upper portion of the ink storage portion of the print head 10, and is connected to the buffer 13 via a pressure introduction valve 21. A communication path 41 is formed for the cap 11 to connect the ejection port side space S1 to the atmosphere, as shown in FIG. 4A, and an atmosphere communication valve 23 is provided for the communication path 41. Further, as shown in FIG. 4A, a blade 43 is provided for the cap 11 to wipe the ejection port face 40 of the print head 10. A buffer valve 22 is provided for the buffer 13 to connect the interior of the buffer 13 with the atmosphere.

During the printing operation, the air relief valve 17 and the pressure introduction valve 21 are closed, and the refill valve 19 is open. Thus, the upper space of the ink storage portion of the print head 10 is a closed space, and a negative pressure due to a difference in hydraulic heads between the print head 10 and the ink cartridge 20 is applied to the ink in the ink storage portion. In accordance with the consumption of ink stored in the print head 10 during the printing operation, the negative pressure in the upper space of the ink storage portion is increased, and when the negative pressure in the upper space has reached a predetermined level or higher, ink from the ink cartridge 20 is supplied to the print head 10, against a negative pressure that is applied, due to a difference in the hydraulic heads, to the ink in the ink storage portion. In this manner, the negative pressure in the upper space of the ink storage portion is employed to automatically supply ink to the print head 10. In order to remove bubbles generated in the print head 10, or air retained in the air extraction chamber 18, the negative pressure in the buffer 13 is employed to evacuate the bubbles from the print head 10 and discharge them to the maintenance tank 16, via the air relief valve 17, the buffer 13 and the suction pump 15.

Further, in a case where a new print head 10 is mounted wherein ink is not yet present in the ink storage portion thereof, the negative pressure in the buffer 13 that is generated by the suction pump 15 is introduced into the upper space of the ink storage portion through the pressure introduction valve 21. Since the negative pressure is supplied to the upper space in this manner, ink is supplied from the ink cartridge 20 to the print head 10, against the negative pressure that is applied to the ink in the ink storage portion due to a difference in hydraulic heads.

Next, the recovery process for the print heads 10 will be described. The recovery process includes the suction-based recovery operation (A), the wiping operation (B) and the preliminary ejection operation (C). These operations will now be described.

(A) Suction-Based Recovery Operation

The suction-based recovery operation can be divided into three sequential stages, a first stage (A-1), a second stage (A-2) and a third stage (A-3). These stages (A-1), (A-2) and (A-3) will now be described.

(A-1) First Stage

Figure 5:
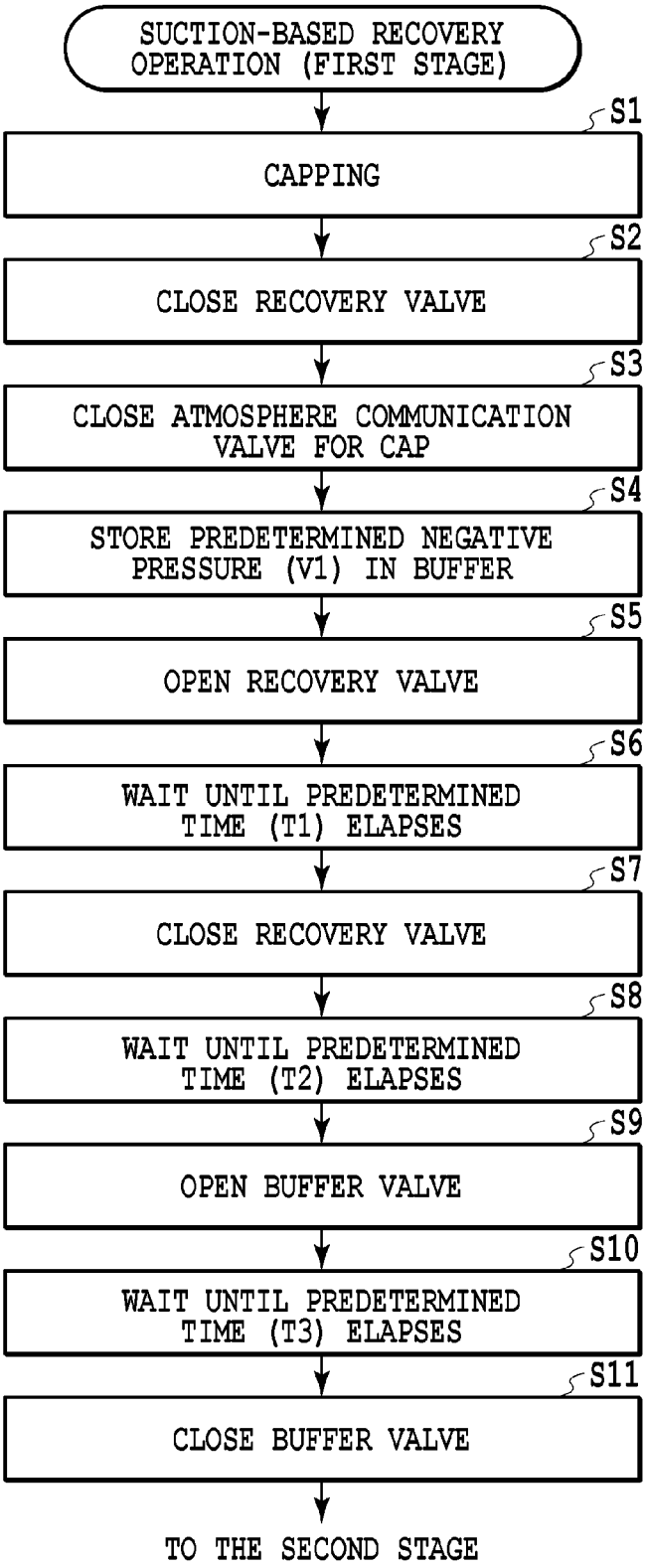
FIG. 5 is a flowchart for explaining the suction-based recovery operation performed by the recovery system in FIG. 3.

FIG. 5 is a flowchart for explaining the first stage of the suction-based recovery operation. The operation shown in the flowchart of FIG. 5 is performed by the CPU 150.

At the time the first stage of the suction-based recovery operation is initiated, the air relief valve 17, the pressure introduction valve 21 and the buffer valve 22 are closed, and the refill valve 19 is open. First, while the recovery valve 14 and the atmosphere communication valve 23 are maintained open, the CPU 150 moves the print head 10 and the cap 11 relative to each other so as to closely contact the ejection port face 40 of the print head 10 and the cap 11 (the capping), as shown in FIG. 3 (step S1). Then the CPU 150 closes the recovery valve 14 and the atmosphere communication valve 23 (steps S2 and S3) to form a closed space in the cap 11, and starts the suction pump 15 to retain a predetermined negative pressure V1 (−40 kPa, in this embodiment) in the buffer 13 (step S4).

Figure 9A:
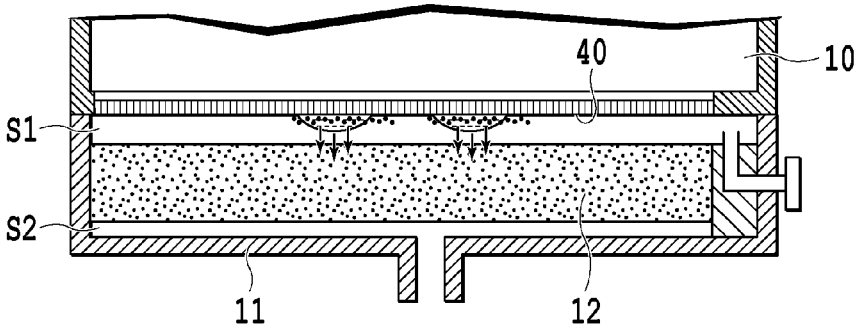
FIGS. 9A, 9B, 9C and 9D are cross-sectional views of a cap during the suction-based recovery operation of the recovery system in FIG. 3.
Figure 9B:
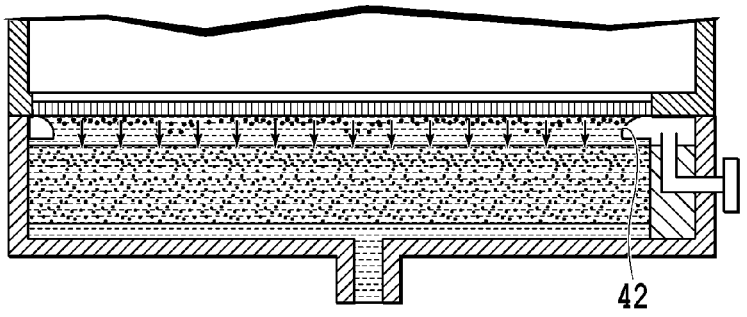
Figure 9C:
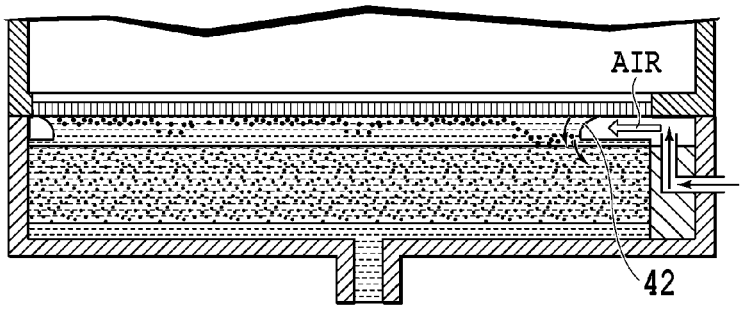
Figure 9D:
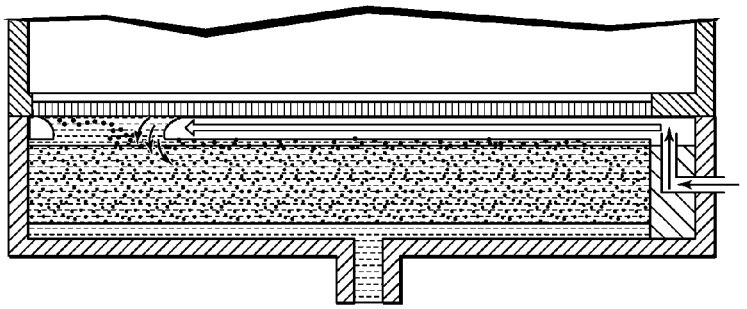
Figure 10A:
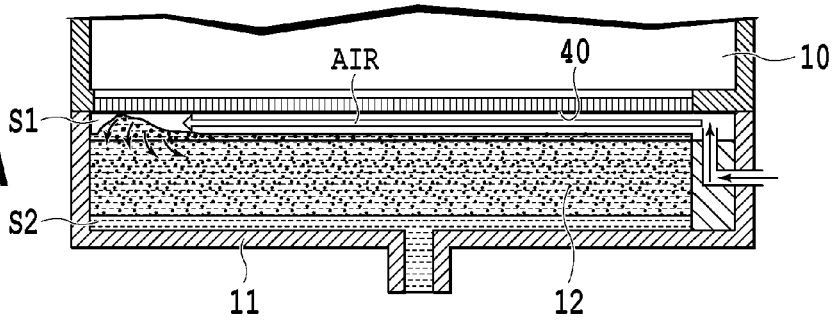
FIGS. 10A, 10B, 10C and 10D are cross-sectional views of a cap during the suction-based recovery operation of the recovery system in FIG. 3.
Figure 10B:
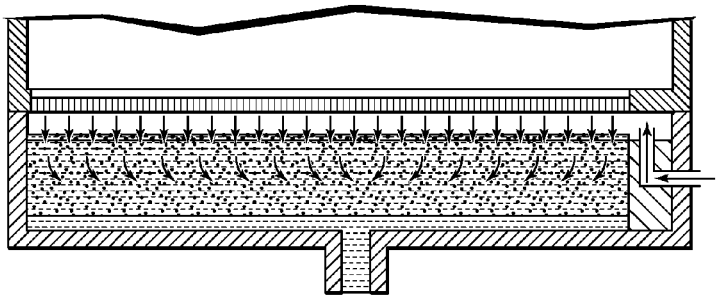
Figure 10C:
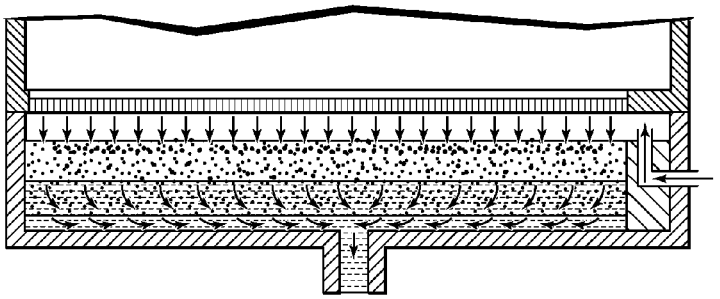
Figure 10D:
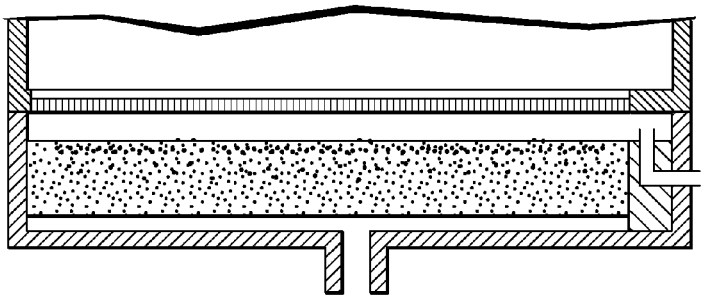

Thereafter, the CPU 150 opens the recovery valve 14 (step S5) and introduces the negative pressure V1 from the buffer 13 into the cap 11 to withdraw ink, by using suction, from the nozzles of the print head 10, as shown in FIG. 9A. As the withdrawal of ink is continued, the ink is absorbed by the absorber 12, and gradually fills the spaces S1 and S2 in the cap 11. Then, when a predetermined time period T1 (five seconds in this embodiment) has elapsed, the CPU 150 closes the recovery valve 14 (steps S6 and S7). Thereafter, the CPU 150 waits for another predetermined time period T2 (six seconds in this embodiment) whereby a pressure Vh for the print head 10 and a pressure Vc for the cap 11 are relaxed to reduce a difference between these two pressures. It should be noted here that the pressure Vh is the pressure in the upper space of the ink storage portion of the print head 10. When the pressure Vh and the pressure Vc are relaxed in this manner, a columnar shape as shown in FIG. 9B is provided for ink between the ejection port face 40 of the print head 10 and the absorber 12. The ink portion in the columnar shape is also referred to as a liquid column 42.

When the liquid column 42 has been formed in this manner, the CPU 150 then opens the buffer valve 22 and exposes the interior of the buffer 13 to the atmosphere in order to return the slightly negative pressure in the buffer 13 to that of the atmosphere (step S9). Thereafter, when a predetermined time period T3 (one second in this embodiment) has elapsed, the CPU 150 recloses the buffer valve 22 (steps S10 and S11).

(A-2) Second Stage

Figure 6:
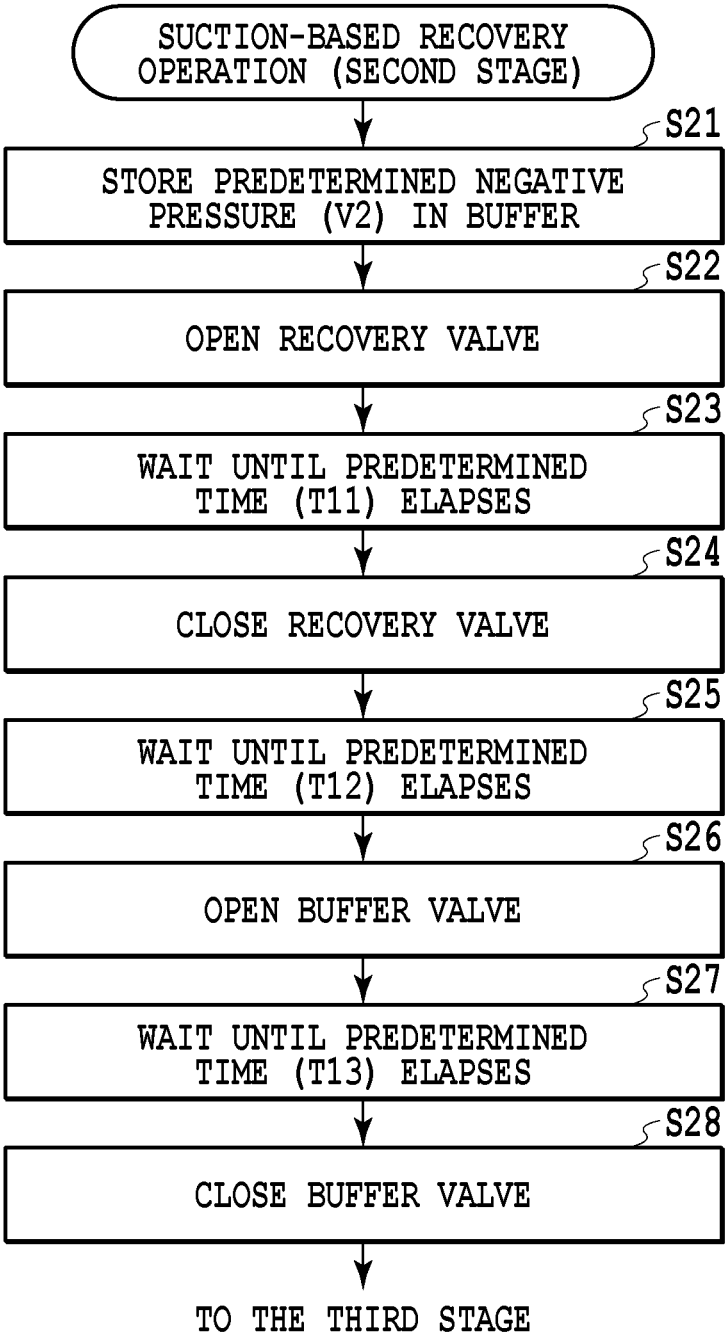
FIG. 6 is a flowchart for explaining the suction-based recovery operation performed by the recovery system in FIG. 3.

FIG. 6 is a flowchart for explaining the second stage of the suction-based recovery operation. The operation shown in the flowchart in FIG. 6 is performed by the CPU 150.

At the second stage, the CPU 150 performs steps S21 and S28, which correspond to steps S4 to S11 of the first stage, to repeat the operation for evacuating ink from the nozzles of the print head 10 by suction. This second suction operation is performed in order to more appropriately form the ink liquid column 42.

First, the CPU 150 accumulates a predetermined negative pressure V2 (−10 kPa in this embodiment) in the buffer 13, and opens the recovery valve 14 (steps S21 and S22). Since the negative pressure V2 is lower than the negative pressure V1 employed for the previously performed first suction operation, a smaller amount of ink is evacuated by suction than was evacuated at the first stage. Since the amount of ink evacuated this manner is added to a plurality of ink droplets on the ejection port face 40, a broader liquid column 42 can be formed. Thereafter, when a predetermined time period T11 (7.5 seconds in this embodiment) has elapsed, the CPU 150 closes the recovery valve 14 (steps S23 and S24). The predetermined period T11 is longer than the predetermined period T1 at step S6, and the evacuation of ink is performed for a longer time than at step S6. The CPU 150 waits for another predetermined period T12 (six seconds in this embodiment) whereby the pressure Vh in the print head 10 and the pressure Vc in the cap 11 are relaxed (step S25). As a result, a liquid column 42 that was not completely formed at the first stage can be appropriately obtained. In the state where the liquid column 42 has been formed, the pressure Vc in the cap 11 is slightly lower than the atmosphere, i.e., a negative pressure, and in this state, the pressure Vh in the print head 10 and the pressure Vc in the cap 11 are balanced, so as not to discharge ink from the nozzles into the cap 11. In a state where the pressure Vh and the pressure Vc are balanced and the ink in the nozzles is not moved, the pressure Vh is not always equal to the pressure Vc because of resistance to flow through the nozzles and the meniscus of ink formed at the ejection ports. The pressure Vh may be lower than the pressure Vc, and is a negative pressure that is lower than the atmospheric pressure.

Following this, the CPU 150 opens the buffer valve 22, releasing the pressure in the buffer 13 to the atmosphere, in order to return the negative pressure in the buffer 13 to that of the atmosphere (step S26). Thereafter, when a predetermined time period T13 (one second in this embodiment) has elapsed, the CPU 150 recloses the buffer valve 22 (steps S27 and S28).

Figure 11:
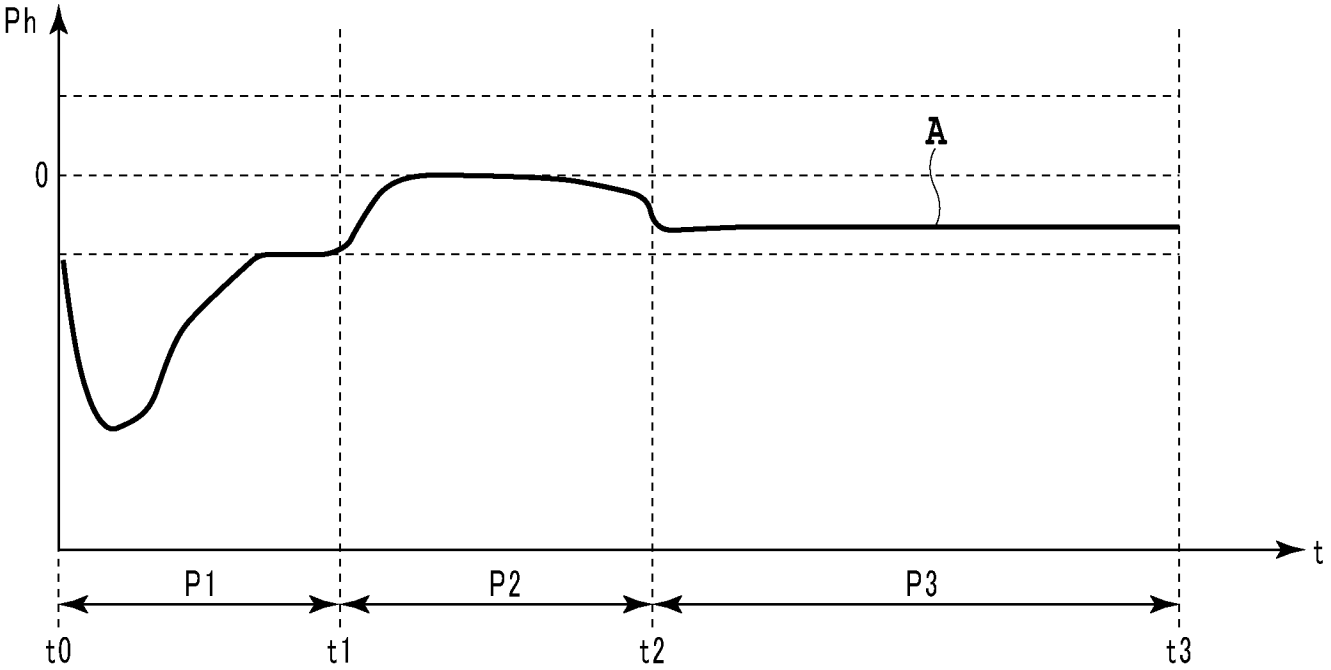
FIG. 11 is a diagram for explaining a pressure change for the print head during the suction-based recovery operation of the recovery system in FIG. 3.

The graph in FIG. 11 shows a curve A for changing the pressure Ph of the print head 10 during the recovery process, and a period P1 from time t0 to t1 corresponds to the processing period from step S21 to S28. In FIG. 11, the atmospheric pressure is set as "0". As described above, until time t1, the pressure Vh and the pressure Vc in the cap 11 are balanced so as not to discharge ink from the nozzles into the cap 11, and the pressure Vh at this time is a negative pressure that is slightly lower than the atmospheric pressure.

(A-3) Third Stage

Figure 7:
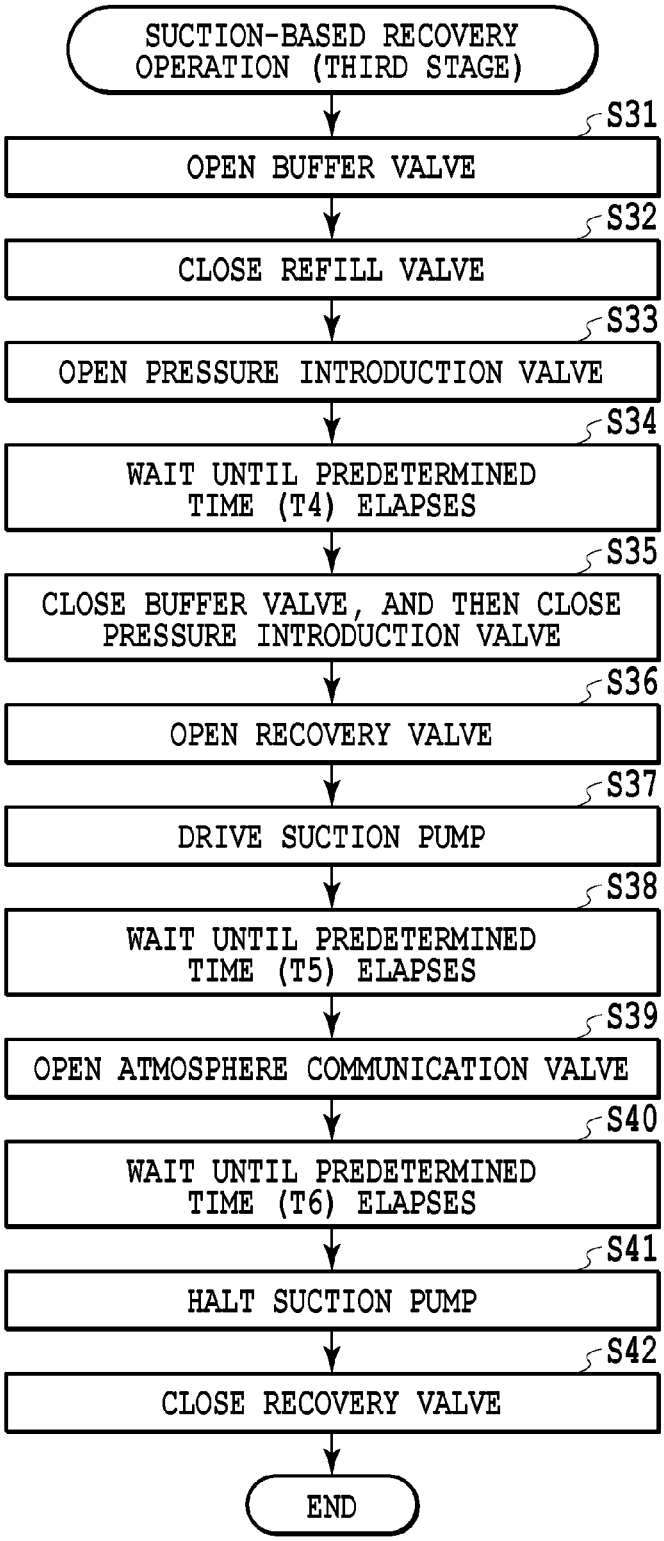
FIG. 7 is a flowchart for explaining the suction-based recovery operation performed by the recovery system in FIG. 3.

FIG. 7 is a flowchart for explaining the third stage of the suction-based recovery operation. The operation shown in the flowchart in FIG. 7 is performed by the CPU 150.

First, the CPU 150 opens the buffer valve 22 to release the pressure in the buffer 13 to the atmosphere (step S31). Then, the CPU 150 closes the refill valve 19 and opens the pressure introduction valve 21 (steps S32 and S33) to introduce the atmospheric pressure of the buffer 13 into the print head 10. When the atmospheric pressure of the buffer 13 is introduced into the print head 10, which is under a slightly negative pressure, the pressure Vh of the print head 10 is increased, and the balance between the pressure Vh and the pressure Vc, to avoid the discharge of ink from the nozzles into the cap 11, is lost. Thus, a small amount of ink is discharged from the nozzles into the cap 11. At this time, since the liquid column 42 has been formed, and the meniscus of the ink does not affect the nozzles, the discharge of ink from the nozzles into the cap 11 occurs easily. When a small amount of ink has been discharged, the pressure Vh and the pressure Vc again become balanced and do not discharge ink through the nozzles.

The refill valve 19 is closed at step S32 because when the atmospheric pressure in the buffer 13 is introduced into the print head 10, which is under a slightly negative pressure, the falling of ink from the print head 10 to the ink cartridge 20 is prevented. There is a hydraulic head difference between the print head 10 and the ink cartridge 20, and in a case where the atmospheric pressure is introduced into the print head 10 while the refill valve 19 is maintained open, ink in the print head 10 may drop into the ink cartridge 20. Further, when the refill valve 19 is closed, the movement range of the ink in the print head 10 can be limited to the nozzles and the cap 11, and therefore, the pressure Vh of the print head 10 is easily controlled.

Sequentially, when a predetermined time period T4 (one second in this embodiment) has elapsed (step S34), the CPU 150 closes the buffer valve 22, and thereafter closes the pressure introduction valve 21 (step S35) and opens the recovery valve 14 (step S36). The recovery valve 14 is opened before the atmosphere communication valve 23 is opened to prevent the leakage of ink from the cap 11 to the exterior via the atmosphere communication valve 23. That is, although the pressure Vh and the pressure Vc are again balanced to prevent the discharge of ink from the nozzles, there is a possibility that, since a small amount of ink was previously discharged through the nozzles, the pressure Vc will be higher than the atmospheric pressure. In a case where the recovery valve 14 is kept closed and the atmosphere communication valve 23 is open, ink in the cap 11 may leak externally, via the atmosphere communication valve 23. In order to prevent such an ink leakage, the recovery valve 14 is opened prior to the atmosphere communication valve 23, and the atmospheric pressure is introduced into the cap 11 to return the pressure Vc to the atmospheric pressure level.

Thereafter, the CPU 150 drives the suction pump 15 (step S37) to withdraw ink, in a predetermined volume (0.1 cc/sec in this embodiment), from the cap 11 via the buffer 13 and the recovery valve 14. Since the suction pump 15 is driven after the recovery valve 14 has been opened, a change in the pressure in the cap 11 can be moderate, and an undesirable effect provided by a sharp change in the pressure can be avoided. When a predetermined time period T5 (one second in this embodiment) has elapsed (step S38), the CPU 150 permits a flow of ink from the cap 11 to the buffer 13, and opens the atmosphere communication valve 23 (step S39) to introduce air into the cap 11.

Sequentially, then, when a predetermined time period T6 (25 seconds in this embodiment) has elapsed (step S40), the CPU 150 halts the suction pump 15 (step S41), and closes the recovery valve 14 (step S42).

As described above, the pressure Vh in the print head 10 and the pressure Vc in the cap 11 are balanced to prevent the discharge of ink through the nozzles, the drawing of ink into the cap 11 is performed to generate a flow of ink, and the atmosphere communication valve 23 is opened to introduce air into the cap 11. As a result, as shown in FIGS. 9C and 9D and FIGS. 10A, 10B, 10C and 10D, the ink in the cap 11 flows in directions indicated by arrows, and is discharged in the manner that the liquid column 42 is pulled apart from the ejection port face 40 and is discharged. Since ink flows in the cap 11 in this manner, ink droplets seldom remain on the ejection port face 40, and dust is removed from the ejection port face 40 by the flow of ink. Since the surface tension of ink is applied to the liquid column 42, the liquid column 42 is drawn in through the absorber 12 that is held in the cap 11.

Furthermore, when the atmosphere communication valve 23 is to be opened, the pressure Vh in the print head 10, which is the atmospheric pressure, is equal to, or slightly higher than the pressure Vc in the cap 11, and the occurrence of a backflow of ink from the cap to the nozzles is suppressed.

In FIG. 11, a period P2, from time t1 to time t2 corresponds to a processing period from step S31 to step S38. At time t1, the pressure introduction valve 21 is open, and the atmospheric pressure is introduced into the print head 10. A period P3 from time t2 to time t3 corresponds to a processing period from step S39 to step S42. At time t2, the atmosphere communication valve 23 is opened and the atmospheric pressure is introduced into the cap 11.

(B) Wiping Operation and (C) Preliminary Ejection Operation

Figure 8:
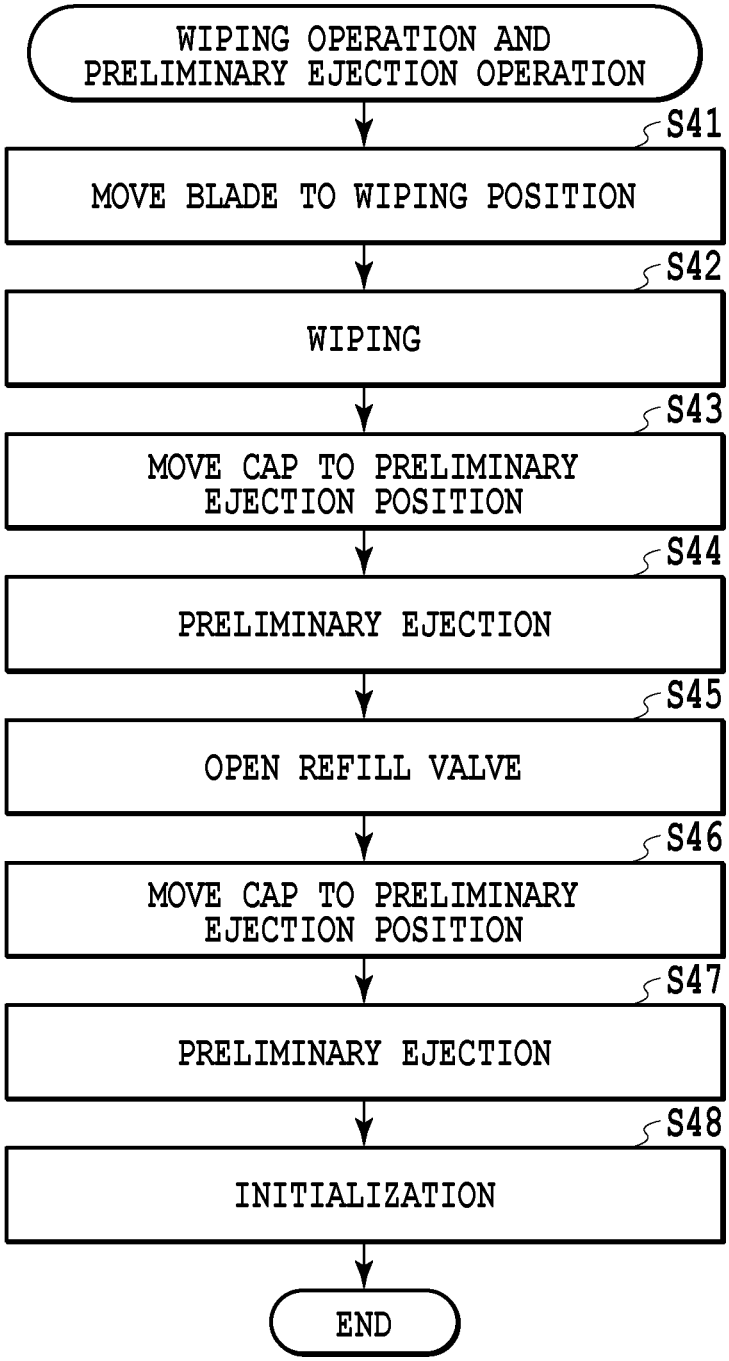
FIG. 8 is a flowchart for explaining the wiping and preliminary ejection operation performed by the recovery system in FIG. 3.

FIG. 8 is a flowchart for explaining the wiping operation and the preliminary ejection operation. The operations shown in the flowchart in FIG. 8 are performed by the CPU 150.

First, the CPU 150 moves the cap 11 relative to the print head 10 to cancel capping by the cap 11, and as shown in FIG. 4A, moves the blade 43, provided for the cap 11, to the wiping position for the print head 10 (step S41). Following this, the CPU 150 moves the cap 11 to the right of the print head 10 in FIG. 4A, and employs the blade 43 to wipe the ejection port face 40 (step S42). The wiping using the blade 43 is performed in an arbitrary direction, and a direction parallel to, or perpendicular to the nozzle array, may be employed.

Then, the CPU 150 moves the cap 11, relative to the print head 10, to the preliminary ejection position (step S43). The preliminary ejection operation is an operation for ejecting, through the nozzles of the print head 10, ink that does not contribute to the printing of an image, and the cap 11 is moved to the preliminary ejection position to accept ink ejected during the preliminary ejection. Thereafter, the CPU 150 performs the preliminary ejection (step S44).

Following this, the CPU 150 opens the refill valve 19 (step S45) to apply, to the print head 10, a negative pressure that is due to a difference in hydraulic heads between the print head 10 and the ink cartridge 20. Thereafter, the CPU 150 moves the cap 11 to the preliminary ejection position, and performs the preliminary ejection in order to adjust the meniscus of ink formed at the ejection ports of the nozzle tips (steps S46 and S47), and performs an initialization process required to terminate the recovery process (step S48).

Second Embodiment

Figure 12:
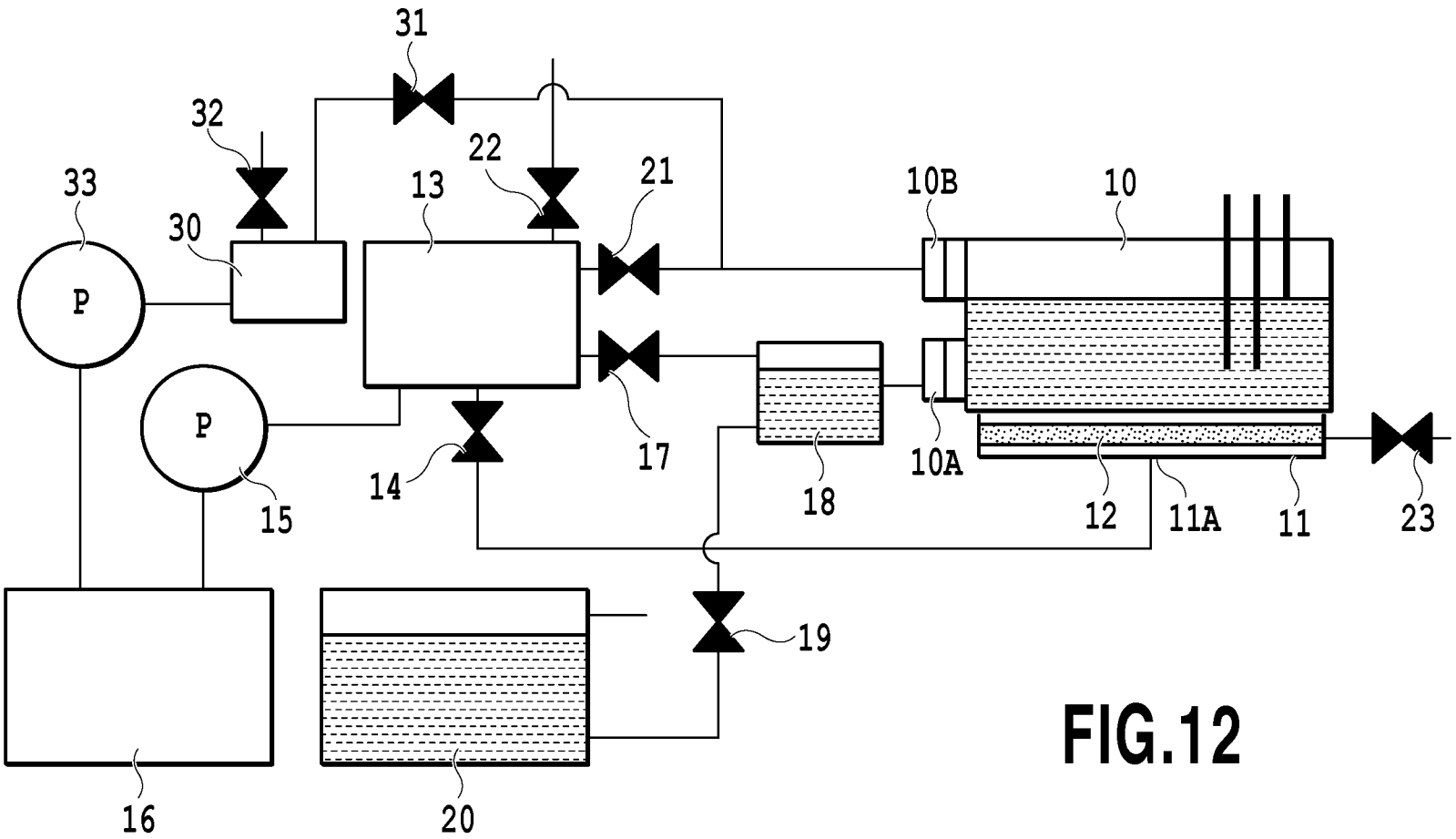
FIG. 12 is a schematic diagram illustrating the arrangement of a recovery system according to a second embodiment of the preset invention.

FIG. 12 is a schematic diagram illustrating the arrangement of a recovery system according to a second embodiment of the present invention. The same reference numerals as used in FIG. 3 for the first embodiment are also provided for corresponding portions, and no further explanation for them will be given.

In this embodiment, a pressure pump 33 that generates a positive pressure, a buffer 30 that temporarily stores the pressure generated by the pressure pump 33, and a pressure introduction valve 31 are connected between a maintenance tank 16 and a pressure introduction port 10B of a print head 10. The pressure pump 33 serves as a pressurization portion that applies the atmospheric pressure, or higher, to the inside of the print head 10. The buffer 30 includes a buffer valve 32 for releasing the internal pressure to the atmosphere, and the pressure pump 33, the pressure introduction valve 31 and the buffer valve 32 are electrically connected to a CPU 150, which controls these components. In the following description, the buffer 13 and the pressure introduction valve 21, provided for the suction pump 15, are referred to as a "first buffer 13" and a "first pressure introduction valve 21", while the buffer 30 and the pressure introduction valve 31, provided for the pressure pump 33, are referred to as a "second buffer 30" and a "second pressure introduction valve 31".

As described above, the recovery system of this embodiment includes the two pumps 15 and 33 that respectively generate a negative pressure and a positive pressure, relative to the atmospheric pressure, and the two buffers 13 and 30 that are provided for the corresponding pumps 15 and 33. The pressures in the buffers 13 and 30 are supplied through the corresponding pressure introduction valves 21 and 31 to the pressure introduction port 10B of the print head 10. Since a pressure lower than the atmospheric pressure and a pressure higher than the atmospheric pressure are supplied to the pressure introduction port 10B, active control of the pressure Vh for the print head 10 can be performed in a way that either increases or reduces the pressure. So long as such control is practiced, another arrangement can be employed, e.g., an arrangement where one buffer is divided into two chambers, or an arrangement where a single pump having the functions of the two pumps 15 and 33 is provided.

Since the suction pump 15 and the buffer 13 are employed for the recovery process of the print head 10, the suction-based recovery operation (A) described in the first embodiment can also be performed for this embodiment.

Furthermore, in this embodiment, suction-based recovery operation (D), which differs from the suction-based recovery operation (A), can also be performed. The suction-based recovery operation (D) will be described below.

(D) Suction-Based Recovery Operation

This suction-based recovery operation can be divided into three sequential stages, i.e., a first stage (D-1), a second stage (D-2) and a third stage (D-3). The first and second stages (D-1) and (D-2) are the same as the first and second stages (A-1) and (A-2) of the suction-based recovery operation (A) described above for the first embodiment. The third stage (D-3) will now be described based on the flowchart in FIG. 13. The operation shown in the flowchart in FIG. 13 is performed by the CPU 150.

Figure 13:
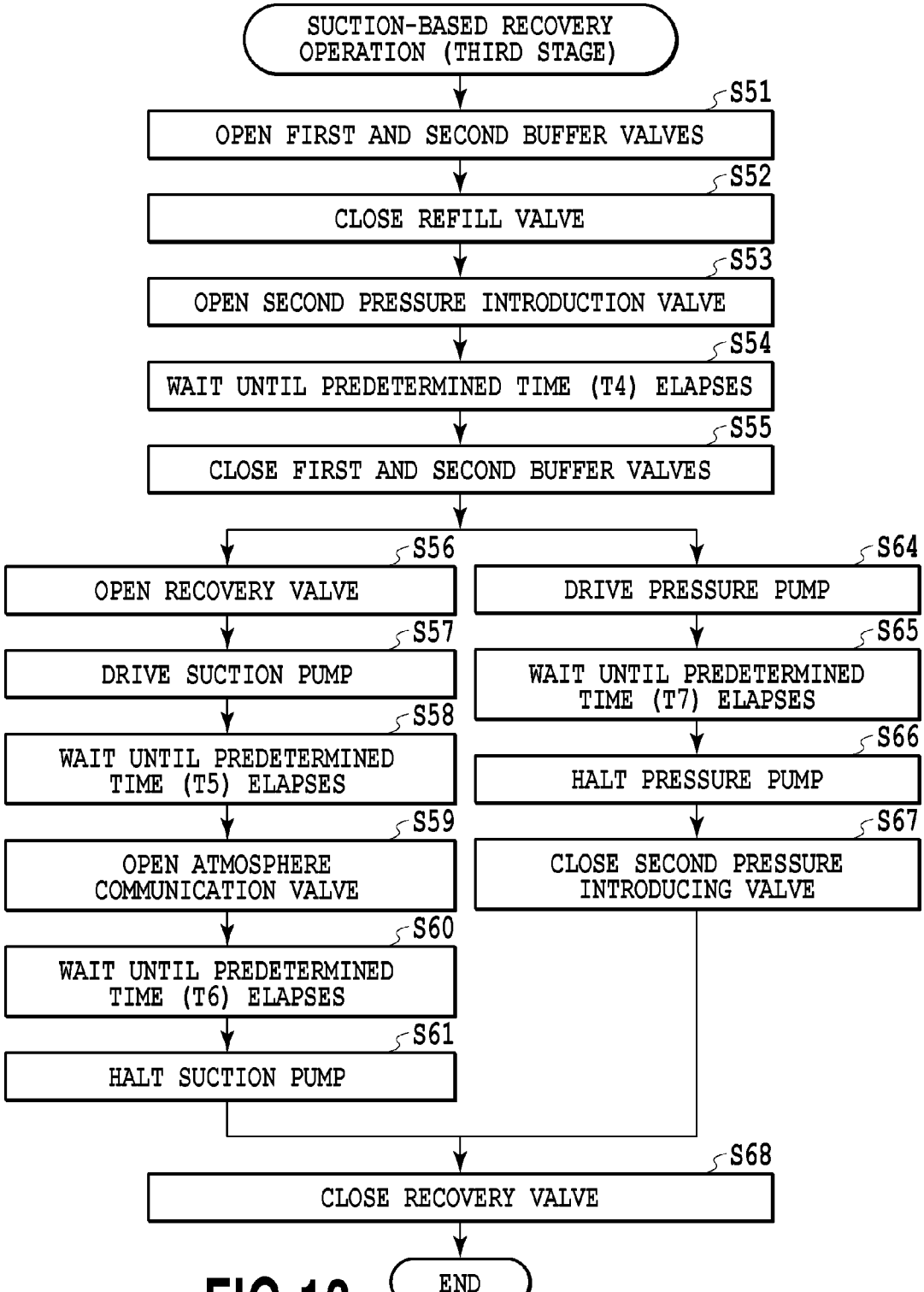
FIG. 13 is a flowchart for explaining the suction-based recovery operation performed by the recovery system in FIG. 12.

The processing from steps S51 to S55 in FIG. 13 is the same as the processing from steps S31 to S35 in FIG. 7, which were previously described. It should be noted, however, that, at step S51, the CPU 150 opens both the first buffer valve 22 and the second buffer valve 32, and at step S55, the CPU 150 closes the first buffer valve 22 and the second buffer valve 32. Following step S55, the CPU 150 performs, in parallel, the process sequence from steps S56 to S61 (hereinafter referred to as a "first process") and the process sequence from step S64 to S67 (hereinafter referred to as a "second process").

The first process is a process related to pressure control for the cap 11, and steps S56 to S61 correspond to steps S36 to S41 in FIG. 7, which were described above. That is, the CPU 150 opens a recovery valve 14 and thereafter drives the suction pump 15 (steps S56 and S57), and when a predetermined time period T5 has elapsed (step S58), the CPU 150 permits the ink to flow from the cap 11 to the buffer 13, and opens an atmosphere communication valve 23 (step S59). As a result, air is introduced into the cap 11. And following this, when the predetermined time period T6 has elapsed, the CPU 150 halts the suction pump 15 (step S61), and closes the recovery valve 14 (step S68).

The second process is a process related to the pressure control for the print head 10. In the second process, the CPU 150 drives the pressure pump 33 (step S64), and introduces the pressure, applied by the pressure pump 33, via the second buffer 30 into the pressure introduction port 10B of the print head 10. Since the pressure pump 33 is driven after the second pressure introduction valve 31 is opened, the pressure in the print head 10 can be moderately changed, and an effect provided by a sharp change in the pressure can be avoided. Sequentially, when a predetermined time period T7 has elapsed (S65), the CPU 150 halts the pressure pump 33 (step S66), and closes the second pressure introduction valve 31 (step S67).

When the first process is performed at the third stage (D-3) in FIG. 13, the control for changing the pressure Ph in the print head, as indicated by the curve A in FIG. 11, can be performed (hereinafter also referred to as the first control). Further, when the first process and the second process are performed at the same time, and in association with each other, control for changing the pressure Ph in the print head 10, as indicated by curves B, C and D in FIG. 14, can be performed (hereinafter also referred to as the second, the third and the fourth control). A period P1 from time t0 to t1 is the same as the period P1 shown in FIG. 11.

The control for changing the pressure Ph, as indicated by the curve B (the second control), the control for changing the pressure Ph, as indicated by the curve C (the third control), and the control for changing the pressure Ph, as indicated by the curve C (the fourth control), will now be described.

(Second Control)

As shown in FIG. 11, for the first control described above, at time t2, whereat the atmosphere communication valve 23 was opened, the pressure Vh in the print head 10 began to drop to the level of the atmospheric pressure, or lower. For the second control, a small pressure force generated by the pressure pump 33 is introduced into the print head 10, so that the pressure Vh in the print head 10 is continued to maintain at the atmospheric pressure level, as indicated by the curve B in FIG. 14, in a period following time t2, whereat the atmosphere communication valve 23 was opened. Specifically, the pressure pump 33 and the pressure introduction valve 31 are controlled to introduce a small pressure force into the print head 10 in synchronization with the time for opening the atmosphere communication valve 23.

According to the second control, while the balance between the pressure Vh and the pressure Vc is maintained to prevent the discharge of ink through the nozzles, air can be introduced into the cap 11, via the atmosphere communication valve 23, by employing the pressure Vh at the atmospheric pressure level. Therefore, as well as in the first embodiment, the occurrence of a backflow of ink to the nozzles can be prevented when the atmosphere communication valve 23 is open.

(Third Control)

In the third control, a small pressure force generated by the pressure pump 33 is introduced into the print head 10 at time t1, whereat the pressure introduction valve 21 was opened and the atmospheric pressure was introduced into the print head 10. As a result, as indicated by the curve C in FIG. 14, the pressure Vh in the print head 10 is increased to the atmospheric pressure level or higher. Then, at time t1, since the liquid column 42 described above is formed, and since meniscus force of ink at the nozzles is zero, a small amount of ink is discharged from the nozzles by introducing a small pressure force into the print head 10, and accordingly, the flow of ink occurs in the print head 10. Since a small amount of ink is discharged through the nozzles, a backflow of ink to the nozzles can be more appropriately prevented. In this state, the suction force of the suction pump 15 is applied to the cap 11 to draw ink from the nozzles into the cap 11.

Following time t2, where the atmosphere communication valve 23 is open, the introduction of a small pressure force into the print head 10 is continued to maintain the pressure Vh at the atmospheric pressure level or higher. At time t2-1 whereat the discharge of the liquid column 42 is completed, the introduction of the small pressure force is halted, and the pressure Vh becomes the atmospheric pressure. Therefore, the introduction of the small pressure force is performed during periods P11 and P12, extended from time t1 to time t2-1, and in a period P13, following time t2-1, the pressure Vh is reduced to the atmospheric pressure.

According to the third control, while the balance between the pressure Vh and the pressure Vc is maintained to prevent the discharge of ink through the nozzles, air can be introduced into the cap 11 via the atmosphere communication valve 23 by employing the pressure Vh at the atmospheric pressure level or higher. Therefore, as well as in the first embodiment, the occurrence of a backflow of ink to the nozzles can be prevented when the atmosphere communication valve 23 is open.

(Fourth Control)

Figure 14:
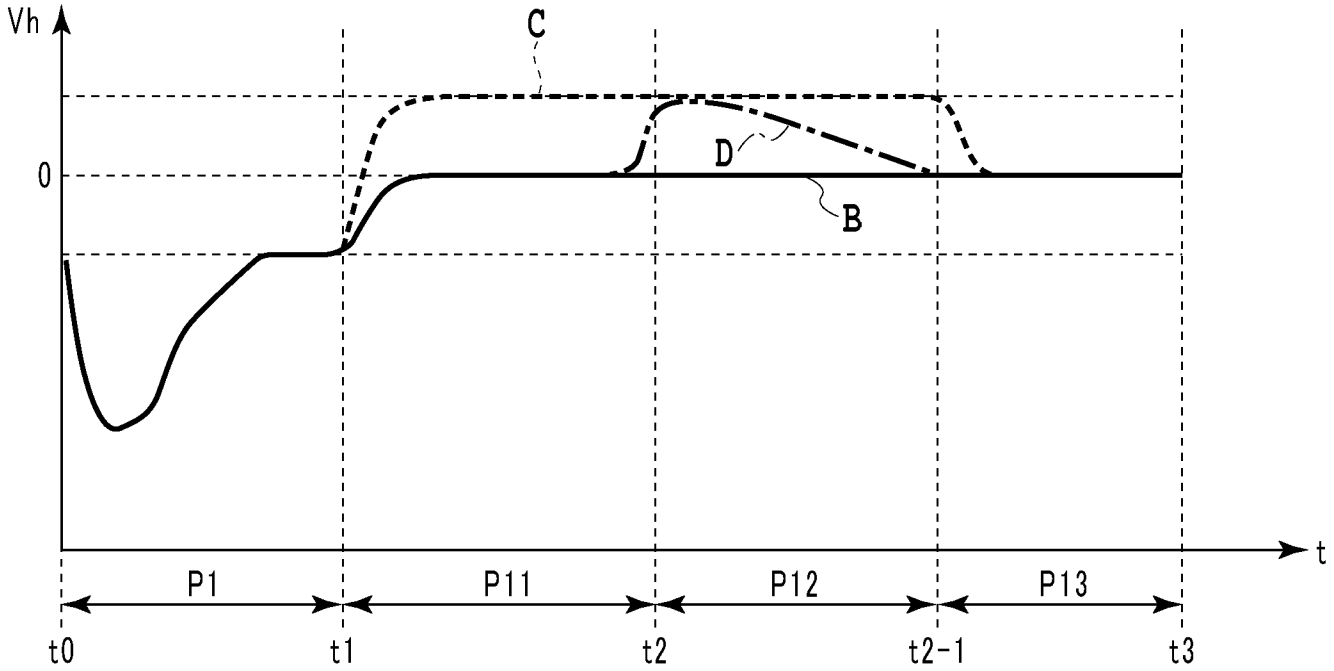
FIG. 14 is a diagram for explaining a pressure change for the print head during the suction-based recovery operation of the recovery system in FIG. 12.

For the fourth control, as indicated by the curve D in FIG. 14, a little before time t2, whereat the atmosphere communication valve 23 is open, a small pressure force is introduced into the print head 10 to increase the pressure Vh to the atmospheric pressure level or higher, and in a period P12, the pressure Vh of the print head 10 is gradually reduced to the atmospheric pressure.

According to the fourth control, as well as the third control, while the balance of the pressure Vh and the pressure Vc is maintained to prevent the discharge of ink through the nozzles, the air can be introduced into the cap 11 via the atmosphere communication valve 23 by employing the pressure Vh at the atmospheric pressure or higher. Therefore, as well as in the first embodiment, the occurrence of a backflow of ink to the nozzles can be prevented when the atmosphere communication valve 23 is open.

Other Embodiment

When at the least, at time t2 whereat the atmosphere communication valve 23 is open, the pressure Vh in the print head 10 is raised to the atmospheric pressure or higher, in the manner performed for the first to the fourth control, the occurrence of a backflow of ink to the nozzles can be prevented when the atmosphere communication valve 23 is open. Therefore, it is simply required that by time t2, the pressure Vh will have been increased, up to the atmospheric pressure level or higher, and an arbitrary period of time for controlling the pressure Vh can be designated. Further, it is preferable that the upper limit, to which to increase the pressure Vh to the atmospheric pressure level or higher, be within a range wherein the balance of the pressure Vh and the pressure Vc can be maintained to prevent the discharge of ink through the nozzles. However, as described above, the upper limit may be within the range wherein a small amount of ink is discharged through the nozzles.

When the pressure Vh is too high, there is a possibility that, after the suction-based recovery operation has been performed, external air may enter the nozzles when a negative pressure, required for printing, is again applied to the ink in the print head 10 by employing a difference in hydraulic heads between the print head 10 and the ink cartridge 20. The pressure Vh should be set by also taking this point into account.

Furthermore, the pressure Vh in the print head 10 is not always increased to the atmospheric pressure level or higher, and need only be increased to a level whereat to prevent the occurrence of a backflow of ink in the nozzles when the atmosphere communication valve 23 is open. That is, it is simply required that, before the inside of the cap is exposed to the atmosphere, a suction force is applied to the interior of the cap, and the internal pressure in the print head is increased.

So long as the cap can cover the ejection ports of the print head, the structure of the cap is not especially limited. Furthermore, the structure of the atmosphere communication portion that can expose the interior of the cap to the atmosphere, and the structure of the pressure increasing portion, which can raise the internal pressure of the print head, are not limited to those described in the embodiments, and other, arbitrary structures may be employed. Furthermore, the structure for applying a negative pressure to ink in the print head is not limited to the structure that employs a difference in hydraulic heads, and a negative pressure application portion, such as an ink absorber, may be employed.

The present invention can be widely applied for various types of ink jet printing apparatuses other than the full-line type, such as a serial scan type. The print head recovery processor for this invention can handle various print heads for ejecting ink, and may be provided as a processing system installed in a printing apparatus, or as a processing system prepared separately from any printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-017176, filed Jan. 31, 2013, which is hereby incorporated by reference herein in its entirety.

What is claimed is:

1. An ink jet printing apparatus for printing an image, the apparatus comprising:

a print head having:

ejection ports capable of ejecting ink;

an ink supply port, ink being supplied to the print head through the ink supply port; and a pressure introduction port, the pressure introduction port being different from the ink supply port;

a cap configured to cover the ejection ports;

a suction unit configured to draw ink from the ejection ports into an interior of the cap by applying a suction force to the interior of the cap;

an atmosphere communication unit configured to expose to the atmosphere the interior of the cap;

a pressure increase unit configured to increase a pressure in an internal of the print head through the pressure introduction port of the print head;

a disconnecting unit capable of disconnecting an ink supply path connected to the ink supply port; and a control unit configured (i) to control the suction unit to apply the suction force to the interior of the cap, (ii) to control the pressure increase unit to increase the pressure in the internal of the print head in a state where the disconnecting unit disconnects the ink supply path, and (iii) to control the atmosphere communication unit to expose the interior of the cap to the atmosphere in a state where the ejection ports are covered with the cap.

2. The ink jet printing apparatus according to claim 1, wherein the pressure increase unit includes an exposure portion configured to expose the interior of the print head to the atmosphere through the pressure introduction port.

3. The ink jet printing apparatus according to claim 1, wherein the pressure increase unit includes a pressure application portion configured to apply a pressure, at the atmospheric level or higher, to the interior of the print head through the pressure introduction port.

4. The ink jet printing apparatus according to claim 1, wherein the control unit controls the suction unit to apply the suction force to the interior of the cap, and to thereafter control the pressure increase unit to increase the pressure in the interior of the print head.

5. The ink jet printing apparatus according to claim 1, wherein the control unit controls the suction unit to apply the suction force to the interior of the cap, and concurrently controls the pressure increase unit to increase the pressure in the interior of the print head.

6. The ink jet printing apparatus according to claim 1, further comprising an absorber configured to divide the interior of the cap into a space opposite the ejection ports and a space to which the suction force is applied by the suction unit.

7. A print head recovery processing device for performing a recovery process for a print head capable of ejecting ink from ejection ports, ink being supplied to the print head through an ink supply port of the print head, the device comprising:

a cap configured to cover the ejection ports;

a suction unit configured to draw ink from the ejection ports into an interior of the cap by applying a suction force to the interior of the cap;

an atmosphere communication unit configured to expose to the atmosphere the interior of the cap;

a pressure increase unit configured to increase a pressure in an internal of the print head through a pressure introduction port of the print head, the pressure introduction port being different from the ink supply port;

a disconnecting unit capable of disconnecting an ink supply path connected to the ink supply port; and a control unit configured (i) to control the suction unit to apply the suction force to the interior of the cap, (ii) to control the pressure increase unit to increase the pressure in the internal of the print head in a state where the disconnecting unit disconnects the ink supply path, and (iii) to control the atmosphere communication unit to expose the interior of the cap to the atmosphere in a state where the ejection ports are covered with the cap.

8. A print head recovery processing method for performing a recovery process for a print head capable of ejecting ink from ejection ports, ink being supplied to the print head through an ink supply port of the print head, the method comprising:

a covering step of covering the ejection ports with a cap;

a drawing step of drawing ink from the ejection ports into an interior of the cap by applying a suction force to the interior of the cap in a state where the ejection ports are covered with the cap;

a disconnecting step of disconnecting an ink supply path connected to the ink supply port;

an increasing step of increasing a pressure in an internal of the print head through a pressure introduction port of the print head in a state where the ink supply path is disconnected at the disconnecting step, the pressure introduction port being different from the ink supply port; and an exposing step of exposing to the atmosphere the interior of the cap.

* * * * *